US006430293B1

(12) United States Patent
Finsterle

(10) Patent No.: US 6,430,293 B1
(45) Date of Patent: Aug. 6, 2002

(54) RECORDING AND PLAY-BACK TWO-CHANNEL SYSTEM FOR PROVIDING A HOLOPHONIC REPRODUCTION OF SOUNDS

(76) Inventor: Luca Gubert Finsterle, Via Pontida, 6, Cernusco sul Naviglio Milan (IT)

( * ) Notice: Subject to any disclaimer, the term of this patent is extended or adjusted under 35 U.S.C. 154(b) by 0 days.

(21) Appl. No.: 09/242,089

(22) PCT Filed: Aug. 5, 1997

(86) PCT No.: PCT/IT97/00204

§ 371 (c)(1),
(2), (4) Date: Feb. 8, 1999

(87) PCT Pub. No.: WO98/07299

PCT Pub. Date: Feb. 19, 1998

(30) Foreign Application Priority Data

Aug. 13, 1996 (IT) ..... MI96A1752

(51) Int. Cl.[7] ..... H04R 5/00
(52) U.S. Cl. ..... 381/17; 381/26; 381/19
(58) Field of Search ..... 381/1, 17, 18, 381/19, 303, 309, 310, 26, 74, 56, 61, 91, 122

(56) References Cited

U.S. PATENT DOCUMENTS

| | | | | | |
|---|---|---|---|---|---|
| 3,892,917 | A | * | 7/1975 | Sotome | 381/17 |
| 3,940,560 | A | * | 2/1976 | Condamines | 381/26 |
| 4,060,696 | A | * | 11/1977 | Iwahara et al. | 381/19 |
| 4,072,821 | A | * | 2/1978 | Bauer | 381/26 |
| 4,119,798 | A | * | 10/1978 | Iwahara | 381/19 |
| 4,466,117 | A | * | 8/1984 | Gorike | 381/26 |
| 4,868,878 | A | * | 9/1989 | Kunugi et al. | 381/1 |
| 5,109,415 | A | * | 4/1992 | Ishida | 381/1 |
| 5,119,420 | A | * | 6/1992 | Kato et al. | 381/1 |
| 5,173,944 | A | * | 12/1992 | Begault | 381/17 |
| 5,208,860 | A | * | 5/1993 | Lowe et al. | 381/17 |
| 5,226,087 | A | * | 7/1993 | Ono et al. | 381/26 |
| 5,412,732 | A | * | 5/1995 | Kanishi et al. | 381/18 |
| 5,850,455 | A | * | 12/1998 | Arnold et al. | 381/1 |

FOREIGN PATENT DOCUMENTS

| | | | | |
|---|---|---|---|---|
| JP | 52-2402 | * | 1/1977 | 381/19 |

* cited by examiner

*Primary Examiner*—Xu Mei
(74) *Attorney, Agent, or Firm*—Hedman & Costigan, P.C.

(57) ABSTRACT

A two-channel sound recording and play-back system for providing a holophonic reproduction or play-back of sounds is herein disclosed. The two-channel recording system comprises cables and electronic apparatus for providing a stereophonic type of recording, where a plurality of microphones are arranged in an adjoining mutually angled relationship so as to provide, during the recording operation, a stereophonic effect due to phase differences at each frequency and an intensity difference at least for middle-high acoustic frequencies. The two-channel sound play-back system comprises, in addition to a source and a two-channel amplifying system, a plurality of diffusers arranged to corners of a parallelogram, a listening point being preferably arranged at the center of said parallelogram, the front or rear diffusers receiving the recorded signal without modifications, whereas, respectively, the rear or front diffusers receive a signal the sound pressure of which is adjusted, by a perspective corrector, from −15 dB to +9 dB, as modified in the frequency response thereof and with a delayed emission, so as to broaden the sound range up to 360°, thereby providing a sound holophonic play-back.

5 Claims, 2 Drawing Sheets

RECORDING AND PLAY-BACK TWO-CHANNEL SYSTEM FOR PROVIDING A HOLOPHONIC REPRODUCTION OF SOUNDS

DESCRIPTION

The present invention relates to a recording and play-back two-=channel system for providing a holophonic reproduction or playback of sounds.

A holophonic reproduction of sounds involves the capability of detecting, during a sound reproduction or playback operation, the space locations of the sound sources, comprising, for example, musical instruments, in a manner similar to that which would have been obtained if the listening person would have been present at the recording place, for example a theater, and this, tendentially, for any positions of the sound sources with respect to the microphones.

By a holophonic type of reproduction, accordingly, it would be possible to perceive in a home reproduction of a symphonic concert not only the locations of orchestral instruments in front of a listener, but also echoes and reverberations coming from the sides and rear of the listener, as well as related applause.

Thus, the obtained effect substantially corresponds to the effective original sound or musical event.

Several solutions are already known for providing a playback more or less fitted to the sound scene, i.e. the bi/three-dimensional representation of a physical space built-in only by sound information.

All the two-channel stereo recordings, either of a multiple-microphone or a two-microphone type, are suitable to playback, by two diffusers, as in a home stereo system, a more or less suitable reconstruction of an original musical event.

In particular, by a stereophonic recording, each stereo system would be able of recovering a sound scene, which, at most, evolves through the space included between the two diffusers in at least two dimensions, i.e. the right-left dimension between the two diffusers, and the near-far dimension starting from an imaginary line connecting the two diffusers, and progressively away from a listening point.

The sole condition to be met by a listener in order to obtain a satisfactory stereophonic effect is to be located ideally at the apex of an equilater triangle, the two other apex points thereof are occupied by the two diffusers.

A bi-three-dimensional representation of a physic space built-in only based on a sound information obtained from a stereophonic system, can evolve through a generally trapezoidal region, where the small base apex points are closer to the listener and are represented by the two diffusers of the system, whereas the apex points of the major base are represented by two points defined by a sound information contents of the recording, such as phase delays and reverberations, sound reflections caused by a home listening room as well as the detecting properties of the diffusers or sound emitting sources.

The above disclosed region is defined as a "sound or acoustic range". By exploiting the high sensitivity of an earing system to phase and frequency response variations, it would be however possible, by a suitable electronic apparatus, to broaden, during the recording operation, the sound range, as reproduced by a stereophonic system, or the area in which it would be possible to reconstruct the virtual sound scene, i.e. that area in which it would be possible to form and perceive again virtual sound subjects, since the latter would be present in said recording.

This technique, which is used, for example, in the so-called Q discs, will always held the positions of the diffusers and of the listening point consistant, thereby theoretically providing a sound field about a the listener.

In order to further broaden the sound range, other two-channel recording and playing-back systems have been made: the so-called quadriphony, i.e. four independent channels, two at the front and two at the rear; the "Dolby-Surround" and all the improvement variations thereof, with four playback channels, i.e. three front channels, central right and left channels, as well as the rear monochannel splitted on two diffusers, and yet other systems including more than four recording and playback channels such as the "Dolby AC3".

These prior systems, which provide to use, during the recording operation, multiple-microphone techniques and electronic signal processing methods, would allow to broaden up to 360° the sound field with at least three channels during the recording and for diffusers during the playback.

Thus, it would be possible to locate sound objects outside the most marked and clean areas of the sound field using only channels with phase rotation and two diffusers, like the above disclosed technique, and as it occurs in the so-called Q-discs.

While the above mentioned prior recording and playback systems solve the mentioned technical problem of a holophonic sound reproduction, they have, however, the disadvantages of an excessively reduced sound field area, actually preventing a true and proper holophonic reproduction.

The Q-disc system, on the other hand, provides a rather unnatural effect due to an insufficient capability of locating the sound subjects the space arrangement of which must be considered with respect to the sound field area.

This derives from several reasons, the main of which is that said diffusers are anyhow perceived as a sound emitting source by a listener, thereby providing a perspective distortion effect.

A sound recorded by a conventional stereophonic method, the original features of which would be such as to always bring that sound to be perceived outside the sound field area, would be anyhow tendentially returned to said area, since the reproduced sound emission occurs at the points occupied by the diffusers. In order to broaden the sound field area, it would be necessary in this case to offset the mentioned prospective distortion by suitable phase rotations and frequency response modifications which, since would not correspond to those naturally perceived for a sound just coming from that space point and, accordingly, would be unnatural. Moreover, during a recording operation, it would be necessary to provide an electronic apparatus for modifying the signal from the microphones and electronic sources, for example an electric guitar which, while perfect, would however introduce distortions in the signals, thereby worsening the reproduced sound quality.

The multiple channel recording and playback system, moreover, involves a coding operation, during the recording operation, in order to include more than two channels in the single two-channel arrangement of the stereophonic software, in addition to a decoding step during the playback operation. While the compatibility with a stereophonic system is satisfactory, the sound field will fall into the sound field area disclosed for the two channel systems, admitted that the playback system is of a stereophonic type.

A further disadvantage is the requirement of coding and decoding recorded signals by an electronic apparatus, which will further distort an original signal.

Moreover, each system including more than two recording channels can not contain, by definition, phase information and frequency response variations like those which would allow a human ear system to reconstruct a sound scene identical to that which would be perceived as present in a original sound event.

Furthermore each effort to broaden the sound field would involve an use of auxiliary electronic apparatus such as phase processors and coders, at least in a recording operation, which apparatus, in addition to worsening the signal quality, would have a very high cost for the required software: discs, CD, and so on.

SUMMARY OF THE INVENTION

Accordingly, the aim of the present invention is to overcome the above mentioned prior art drawbacks.

In order to achieve the above mentioned aim, the present invention provides a two-channel sound recording and playback system, suitable to provide a holophonic reproduction of sounds which is constructionally simple, of low cost and provides an end playback result which is more natural and realistic than that obtained by recording and playback sounds by three of more channels, thereby providing a sound reproduction which is substantially identical to the original sound event, in particular with respect to the original three-dimensional reconstruction, i.e. an actually holophonic reproduction of sounds.

According to the invention, a two-channel sound recording and playback system is herein provided, suitable for holophonically playing-back sounds, wherein said recording system comprises cables and electronic apparatus to provide a stereophonic recording, and in which are moreover provided a plurality of microphones arranged in a close and angled relationship, so as to provide, in a recording operation, a stereophonic effect from phase differences for each frequency and from intensity differences for at least sound frequencies greater than 200 Hz, and wherein the sound playback system comprises a source and a two-channel amplifying system, a plurality of diffusers being moreover arranged at corners of a parallelogram, where the listening point is arranged at the centre of said parallelogram, the front or rear diffusers receiving the recorded signals without modifications, whereas, respectively, the rear or front diffusers receive a signal adjusted by a perspective corrector for correcting the sound pressure from −15 dB to +9 dB, as modified in the frequency response and delayed in emission so as to broaden the sound field up to 360°, thereby providing a sound holophonic playback.

The two-channel recording and playback system for providing a sound holophonic reproduction according to the invention is characterized in that it comprises the characterizing features of claims 1 and 5.

The two-channel sound recording and playback system, suitable for providing a sound holophonic reproduction according to the invention provides the following advantages.

With respect to a conventional stereophonic playback, the subject system provides, in a playback operation performed by conventional stereophonic systems, an increase of the sound field area, independently from the diffusers.

Moreover, the sound information is not further distorted since no signal processing or codifying system is provided for holding further channels in addition to the two-channels provided in a conventional stereophonic system.

Moreover, the system according to the invention allows to clearly perceive sounds coming from the rear part of the shoulders of a listener, as well as laterally, if said sounds are present in the original sound event: for example the rear echoes of a concert room, or applause of persons arranged on the rear portion of the microphonic system.

A further advantage is that of providing a holophonic sound recording and playback by simply adding, in a recording studio, the elements characterizing the present invention.

This advantage, moreover, would be mainly valid also for a playback operation for users already having a conventional stereophonic system.

Finally, independently from the used recording system, the following advantages will be obtained during the playback operation: an increase of the three-dimensional effect of virtual sounds present in the sound field area; for example, by listening from the listening point a person would have the feeling of touching a violin on the front with a consequent encompassing effect; an increase of the sound field which is also increased beyond the diffusers while remaining in front of the listener; an increase of the depth feeling of the front area of the sound field and, finally, a general feeling of a greater playback naturalness and realism.

BRIEF DESCRIPTION OF THE DRAWINGS

Further characteristics, advantages and details of the two-channel sound recording and playback system for providing a holophonic sound reproduction according to the present invention will become more apparent hereinafter from the following detailed disclosure, with reference to the accompanying drawings, which illustrate, by way of an indicative, but not limitative, example, a preferred embodiment thereof, and in which.

DESCRIPTION OF THE PREFERRED EMBODIMENTS

Figure 1:
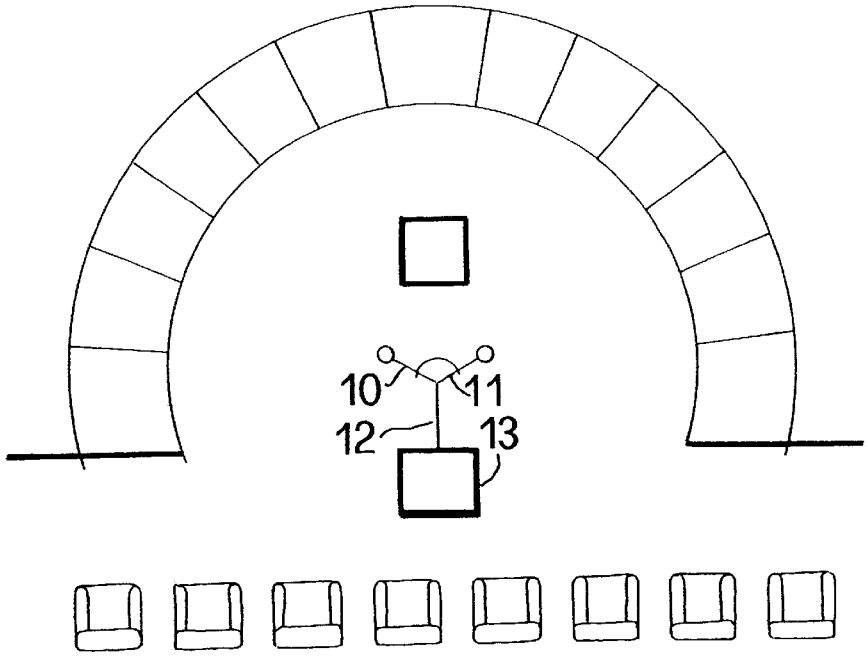
FIG. 1 schematically illustrates a recording step performed by using the system according to the present invention.

With reference to the number references of FIG. 1, the two-channel sound recording system suitable to provide a holophonic reproduction of sounds according to the invention, comprises two pickup microphones 10, 11 having omnidirectional features or cardioid or with all of the intermediate cases. If a plurality of microphones are provided, then they could have directive ipercardioid or club patterns characteristics.

The microphones 10, 11 are arranged with their membranes so that the distance from a microphone to the other would be from 15 to 25 cm, preferably from 19 to 21 cm, whereas the angle of said microphones would preferably be from 120° to 200°.

During the recording operation, the microphones must be arranged at such physical locations that a listener arranged herein would obtain a realistic representation of the spatial reconstruction acoustically obtained from a musical event, without the need of constructing this representation by visual images, the representation being only based on a sound information.

The above mentioned microphone arrangement must be such as to provide, during the recording operation, a stereophonic effect deriving from a phase difference at each frequency and, for intensity differences, at least for frequencies greater than 200 Hz.

The frequency response sum of the two channels must show a total frequency response within ±5 dB, for any locations on the horizontal plane, with respect to the microphone axes, of the sound emitting source.

The recording system should comprise cables 12 and electronic apparatus 13 adapted, in cooperation with the microphones 10, 11, to hold the phase response for each frequency from 20 Hz and 10000 Hz within ±20°.

Figure 2:
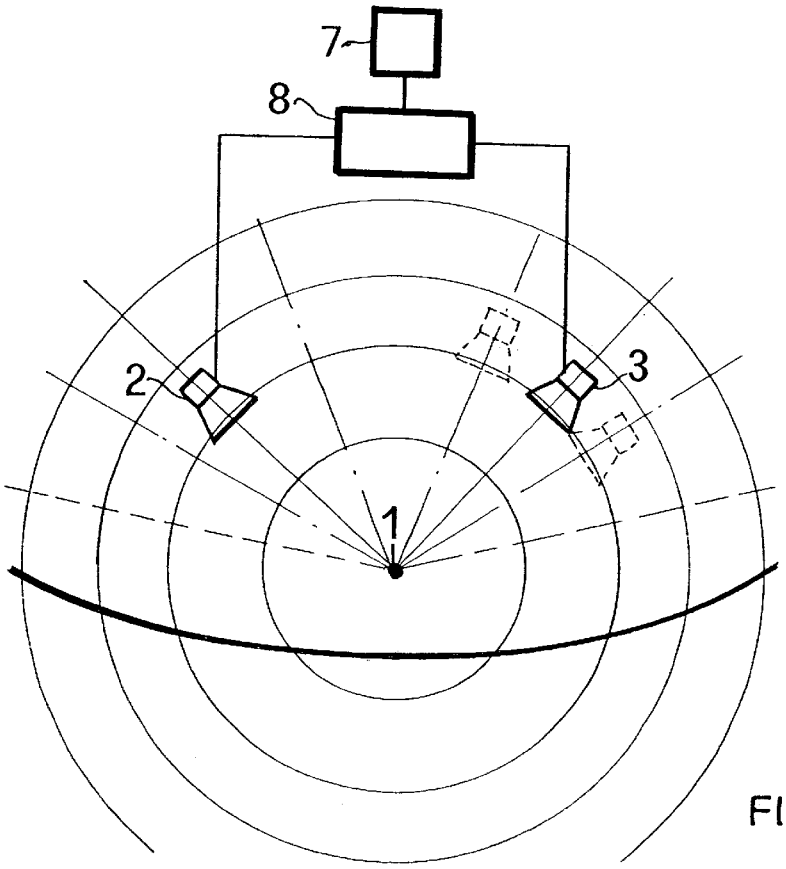
FIG. 2 illustrates the sound field in which are perceived virtual sound sources, as obtained by the present invention by using only two diffusers for the playback.
Figure 3:
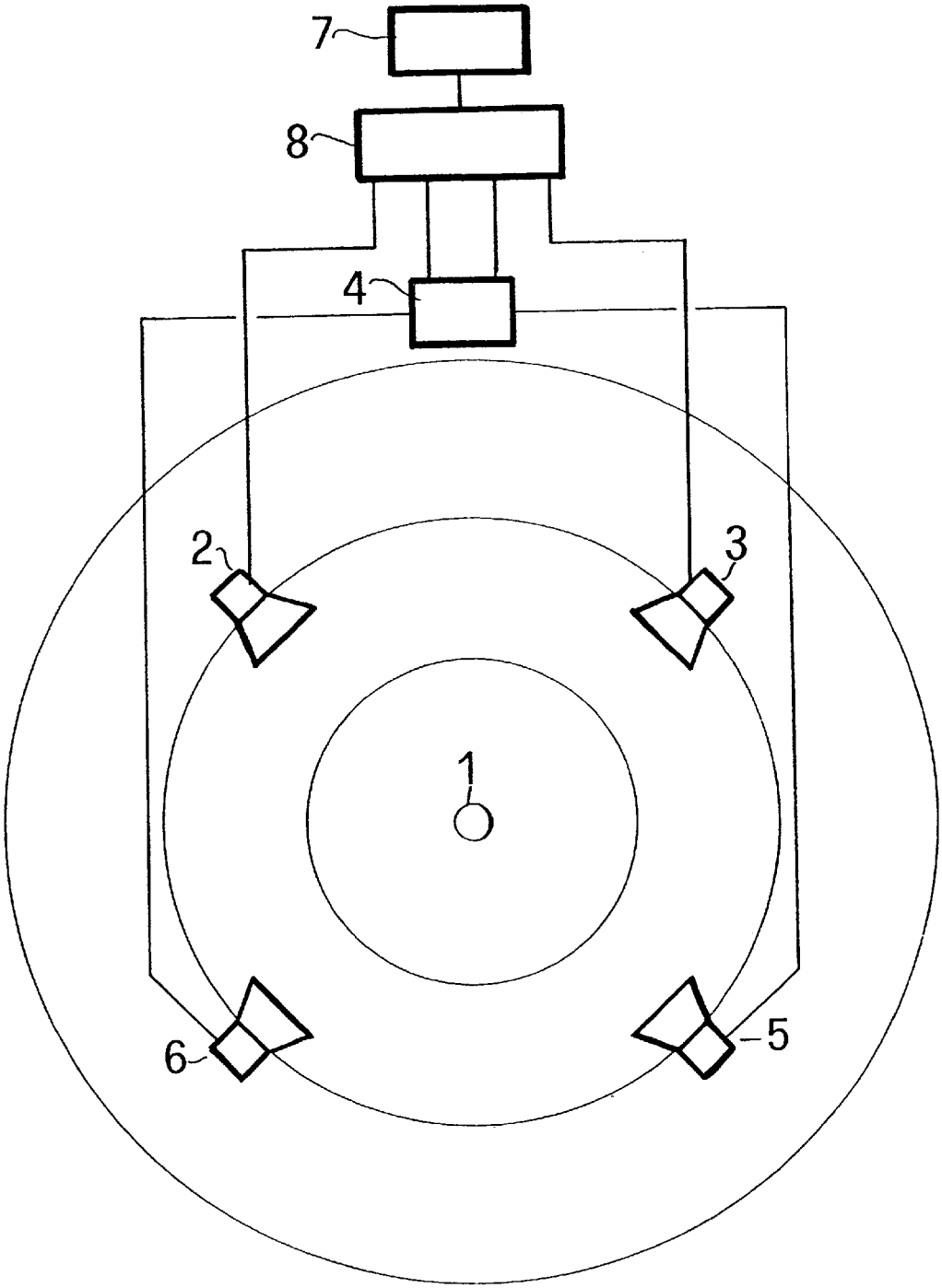
FIG. 3 illustrates the sound field in which are perceived virtual sound sources, by using all the means provided according to the present invention.

With reference to the number references of FIGS. 2, 3, the two-channel sound playback system, suitable to provide a holophonic sound playback according to the invention, comprises a sound source 7, an amplifying system 8, of a two-channel type, and two front diffusers 2, 3 so that the angle formed by the line joining the listening point 1 and said front diffusers 2, 3 is of 90° with a tolerance of plus or minus 30°. The above mentioned diffusers 2 and 3 will be oriented toward the listening point 1.

In such a configuration of the listening system, the sound field area will also extend to the rear of the listener, thereby providing an opening of about 180°, i.e. about three times that value which would be obtained by conventional stereophonic recording systems.

In order to further increase or broaden the sound field area, the subject system comprises moreover an electronic apparatus 4, called "perspective corrector" as well as two rear diffusers 5, 6 which are symmetrically arranged with respect to the two front diffusers 2, 3, i.e. with respect to the listening point 1: the rear diffusers 5, 6, accordingly, are arranged with respect to the first two diffusers 2, 3 so that the listening point 1 is arranged on the center of an ideal rectangle formed by the four diffusers, while considering the disclosed tolerances affecting the locations of said diffusers.

Preferably, the locations of the middle-high frequency transducers located in the four diffusers 2, 3, 5, 6 will correspond to the level or height of the ears of a listener arranged at the point 1: in other words at 1–1.2 meters from ground in a case of sitting listener.

The electronic apparatus 4 operates a send to the rear diffusers 5, 6 a signal similar to that sent by the amplifier system 8 to the front diffusers 2 and 3, so as to obtain from the rear diffusers 5, 6 sounds which, with respect to the dynamic frequency response and distortion as well as phase response, would be substantially identical to those provided by the front diffusers 2, 3 but having a sound pressure adjusted in a range from −15 dB to +9 dB, preferably from −10 dB to +6 dB.

Moreover, in order to further improve, in a playback-step, the possibility of properly detecting the locations of the virtual sound events on the rear of the listener, which, originally, in the recording place, where sent on the rear of the microphone pick up system, it would be possible to attenuate or enhance the middle and/or high frequencies, and in addition to cut off the low frequencies, or slightly delay the emission of the rear diffusers 5, 6 with respect to the front diffusers 2 and 3, i.e. in the disclosed example, only for the rear diffusers 5, 6 and through the perspective corrector 4.

Preferably, the electronic apparatus 4, or perspective corrector has the following features: a gain varying from −50 dB to +20 dB; a high-pass filter having a cut off frequency from o Hz to 5,000 Hz, with a slope equal to or greater than 6 dB/oct, preferably from 6 dB/oct to 18 dB/oct; a variable middle-high frequency adjuster (from −10 dB to +10 dB) having a center at 4,000 Hz and an operation field from 2,000 Hz to 10,000 Hz; a variable high frequency adjuster (from −10 dB to +10 dB) for adjusting high frequencies from 10 KHz and 20 KHz.

Said apparatus comprises moreover a circuit for correcting the frequency response and acoustic phase in order to make the sounds emitted from the rear diffusers 5, 6 similar to those emitted by the front diffusers 2, 3 or, if desired, to modify the phase response of the rear diffusers 5, 6.

Finally, the general phase response of the playback system according to the present invention must be linear within ±20° for each frequency from 20 Hz to 2,000 Hz at the listening point 1.

Thus, the recording and playback system according to the present invention provides to use the two additional rear diffusers 5, 6 which, together with the control electronic apparatus called "perspective corrector 4", will have a frequency response phase response, dynamic and distortion characteristics similar or identical to those of the front diffusers.

This identity can also be achieved electronically if the rear diffusers 5 and 6 are not identical to the front diffusers 2, 3, by an equilization and adjustment of the phase response by a specifically provided circuit to be added to the disclosed electronic apparatus for sending a corrected signal to the rear diffusers 5, 6.

More specifically, said diffusers must be arranged in mirror-like arrangement with respect to the front diffusers 2, 3, i.e. with respect to the listening point 1, with the same tolerances related to an ideally correct position; if they are closer, then, by the perspective corrector 4, a virtual position provided with a congruent delay will be simulated, which will be, from a distance standpoint, similar to that of the front diffusers 2, 3 from the listening point.

Thus a 360° reconstruction of the virtual sound scene on a horizontal plane and partially on a vertical plane will be obtained, since it will be possible to reduce the perspective distortion occurring in listening from the front diffusers only.

This perspective distortion reduction is obtained, according to the present invention, by sending to the rear diffusers 5 and 6 the same identical signals sent to the front diffusers 2, 3, said signals being however adjusted and/or cut and/or delayed so as to provide a broadening of the sound field up to 360°, or less, depending on the listener requirements.

The above mentioned adjustments will depend on the size and acoustic absorption features of the listening room and on the listener requirements.

In particular, this effect is basically obtained due to the cooperation of two specific properties of the recording and playback system according to the present invention.

A microphonic pickup which records sounds at two space points. i.e. those immediately near the ears of a human head, thereby holding the signal phase characteristics unchanged, and providing a stereophonic effect derived from a frequency dependant phase and intensity difference.

Moreover, the rear diffusers 5, 6, which would be variously attenuated and filtered and properly arranged, will provide, by adding the signals from the front and rear channels, a virtual sound emission point not coinciding with the front diffusers 2, 3, thereby reducing the perspective distortion and broadening the sound field to 360° about a listener properly arranged with respect to the diffusers 2, 3, 5, 6 at the listening point 1.

This is obtained during the recording operation due to the particular locations of the microphones 10, 11 allowing the four diffusers 2, 3, 4, 6 and prospective corrector 4 to send, through the ear reproduction apparatus, in an optimum manner, all of the phase information related to sound sources, by ideally zeroing any perspective distortions from the front diffusers 2, 3, by adding an identical and opposite distortion induced by the rear channels and a consequent generation of an emission point always arranged on the front or, at most, on one the sides, and different from the localized diffusers, since the rear diffusers 5 and 6 will be always suitably adjusted with respect to the front diffusers 2, 3.

Thus, a two virtual diffuser sound emission will be provided, said virtual diffusers being devoice of any spatial locating features: thus the sound will be perfectly holophonically reproduced.

In this connection it should be pointed out that the zeroing of the perspective distortion related to two diffusers only can also be obtained, in a opposite manner to the above, by holding unchanged the signal related to the rear diffusers 5 and 6 and by operating, by the perspective corrector 4, on the front diffusers 2, 3, so as to adjust and delay the signal transmitted to said front diffusers, thereby providing again an holophonic playback of sounds.

Finally, it should be apparent that the mentioned sound playback features can also be mainly obtained by a software recorded by conventional methods.

It should be moreover pointed out that the configurations and size of the several elements constituting the subject two-channel sound recording and playback system suitable to provide a holophonic reproduction of sounds according to the invention can vary according to requirements, without departing from the scope of the invention as above disclosed.

What is claimed is:

1. A two-channel recording system providing a holophonic reproduction of sounds comprising cables (12) and electronic apparatus (13) for providing a stereophonic recording, and a plurality of microphones (10, 11), characterized in that the membranes of said microphones are arranged in a close and angled mutual relationship so as to provide, during a recording operation, a stereophonic effect derived from phase differences for each frequency and from intensity differences at least for sound frequencies greater than 200 Hz, the distance between said membranes being from 15 cm to 25 cm, and the angle thereof being from 120° to 200°, that said microphones have omnidirectional directive characteristics, cardioid with any intermediate patterns, hypercardioids, or club patterns, that the frequency response sum of said two-channels shows a total frequency response within ±5 dB for each location on a horizontal plane, with respect to the axes of said microphones (10, 11) of the sound emitting source, and that said cable (12), electronics apparatus (13) and microphones (10, 11) have a total phase response for each frequency from 20 Hz to 20,000 Hz, within ±20°.

2. A two-channel playback system providing a holophonic reproduction of sounds, comprising a sound source (7), a two-channel amplifying system, and a plurality of front and rear diffusers (2, 3, 4, 6), characterized in that said front and rear diffusers are arranged at the apex points of a quadrilater, the listening point (1) thereof is arranged at the center of said quadrilater, the angle formed by the lines joining the front diffusers (2, 3) to the listening point (1) and the rear diffusers (5, 6) to the listening point (1) varying from 60° to 120°, each said diffusers (2, 3, 4, 6) being oriented toward said listening point (1), the front diffusers (2, 3) or rear diffusers (5, 6) receiving an unmodified recorded signal, whereas, respectively, the rear diffusers (5, 6) or front diffusers (2, 3) receive a signal adjusted by at least a perspective corrector (4) controlling the sound pressure of said signal from −15 dB to +9 dB, as modified in the frequency response and delayed in emission so as to broaden the sound field up to 360°, thereby providing a sound holophonic reproduction.

3. A two-channel playback system according to claim 2, characterized in that said perspective corrector (4) has a gain varying from −50 dB to +20 dB and comprises a high-pass filter with a cut frequency varying from 0 Hz to 5,000 Hz with a slope equal to or greater than 6 dB/oct, an adjuster variable from −10 dB to +10 dB for adjusting the middle-acute frequencies with a center at 4,000 Hz and an operating range from 2,000 Hz to 10,000 Hz, a further variable adjuster within the range from −10 dB to +10 dB for adjusting the acute frequencies from 10 KHz to 20 KHz, a delay circuit providing a delay from 0 ms to 21 ms and a correcting circuit for correcting the frequency response and acoustic phase, suitable to modify the signal sent to the diffusers coupled to said perspective corrector (4).

4. A two-channel playback system according to claim 2, characterized in that the total phase response of said playback system is linear within ±20° and for each frequency from 20 Hz to 20,000 Hz at said listening point (1).

5. A two-channel playback system according to claim 2, characterized in that said diffusers (2, 3, 5, 6) comprise moreover middle-acute frequency transducers arranged at the level of the ears of a listener positioned at said listening point (1).

* * * * *